US006445902B1

(12) United States Patent
Hirst et al.

(10) Patent No.: US 6,445,902 B1
(45) Date of Patent: Sep. 3, 2002

(54) SIMPLIFIED FUSING SYSTEM

(75) Inventors: B. Mark Hirst, Boise, ID (US); Mark Wibbels, Boise, ID (US); Kenneth E. Heath, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/819,499

(22) Filed: Mar. 28, 2001

(51) Int. Cl.[7] ..... G03G 15/20; H05B 1/00
(52) U.S. Cl. ..... 399/328; 219/216; 219/619
(58) Field of Search ..... 219/216, 619; 399/320, 328, 329, 330, 331, 334, 335, 336

(56) References Cited

U.S. PATENT DOCUMENTS

| | | | | | |
|---|---|---|---|---|---|
| 4,905,050 | A | * | 2/1990 | Derimiggio et al. | 399/328 |
| 5,450,183 | A | | 9/1995 | O'Leary | 399/328 |
| 5,789,723 | A | | 8/1998 | Hirst | 219/501 |
| 5,839,043 | A | | 11/1998 | Okabayashi et al. | 399/329 |
| 5,984,848 | A | | 11/1999 | Hyllberg et al. | 492/46 |
| 6,018,151 | A | | 1/2000 | Hirst | 219/497 |
| 6,021,303 | A | * | 2/2000 | Terada et al. | 399/328 |
| 6,026,273 | A | | 2/2000 | Kinouchi et al. | 399/328 |
| 6,078,781 | A | | 6/2000 | Takagi et al. | 399/330 |
| 6,122,478 | A | | 9/2000 | Hirst | 399/330 |
| 6,181,891 | B1 | | 1/2001 | Higashi et al. | 399/70 |
| 6,292,648 | B1 | | 9/2001 | Higaya et al. | 399/335 |
| 6,304,740 | B1 | * | 10/2001 | Ciaschi et al. | 399/328 |

FOREIGN PATENT DOCUMENTS

| | | |
|---|---|---|
| JP | 7-295414 | 11/1995 |
| JP | 869190 | 3/1996 |
| JP | 11-297462 | 10/1999 |
| JP | 2000-187406 | 7/2000 |
| JP | 2000-214713 | 8/2000 |
| JP | 2000-214714 | 8/2000 |
| JP | 2000-235329 | 8/2000 |

* cited by examiner

*Primary Examiner*—Hoang Ngo

(57) ABSTRACT

The present disclosure relates to a fusing system for fusing toner to a recording medium. The fusing system comprises a fuser roller that does not have an internal heat source, a pressure roller that does not have an internal heat source, the pressure roller being in contact with the fuser roller, and an external heat source that heats at least one of the fuser and pressure rollers.

12 Claims, 5 Drawing Sheets

SIMPLIFIED FUSING SYSTEM

FIELD OF THE INVENTION

The present disclosure relates to a simplified fusing system. More particularly, the present disclosure relates to a fusing system in which several of the components typically associated with the fusing system need not be replaced along with fusing system rollers.

BACKGROUND OF THE INVENTION

Electrophotographic printing and copying devices typically are provided with fusing systems that serve to thermally fuse a toner image onto a recording medium, such as a sheet of paper. Such fusing systems normally comprise a heated fuser roller and a heated pressure roller that presses against the fuser roller to form a nip in which the fusing occurs. FIG. 1 illustrates a simplified end view of a typical prior art fusing system 100. As indicated in FIG. 1, the fusing system 100 generally comprises a fuser roller 102, a pressure roller 104, internal heating elements 106, and a temperature sensor 108. The fuser and pressure rollers 102 and 104 comprise hollow tubes 110 and 112 that are coated with outer layers 114 and 116 of elastomeric material.

The internal heating elements 106 typically comprise halogen lamps that uniformly irradiate the inner surfaces of the rollers 102 and 104. Through this irradiation, the inner surfaces are heated and this heat diffuses to the outer surfaces of the fuser and pressure rollers 102 and 104 until they reach a temperature sufficient to melt the toner (e.g., approximately between 160° C. to 190° C.). The fuser roller and the pressure rollers 102 and 104 rotate in opposite directions and are urged together so as to form a nip 118 that compresses the outer layers 114 and 116 of the rollers together. The compression of these layers increases the width of the nip 118, which increases the time that the recording medium resides in the nip. The longer the dwell time in the nip 118, the larger the total energy that the toner and recording medium can absorb to melt the toner. Within the nip 118, the toner is melted and fused to the medium by the pressure exerted on it by the two rollers 102 and 104. After the toner has been fused, the recording medium is typically forwarded to a discharge roller (not shown) that conveys the medium to a discharge tray.

Normally, fusing systems such as that depicted in FIG. 1 are periodically replaced because of degradation of the outer layers of the fuser and pressure rollers. This degradation normally occurs due to the high temperatures to which the fuser and pressure rollers are exposed during use. In particular, the outer layers tend to delaminate over time due to these temperatures. In that the internal heating elements comprise integral parts of the fuser and pressure rollers, these elements are normally discarded along with the rollers. In addition, the temperature sensors and electrical connectors associated with the rollers and/or the internal heating elements are also discarded.

Discarding of the internal heating elements and the other components identified above is disadvantageous for several reasons. First, these components are relatively expensive and therefore significantly increase (e.g., approximately double) the cost of the replacement fusing system. In that such replacement typically occurs several (e.g., four or more) times over the life of the imaging device, these costs are multiplied. Second, the required replacement of these components is wasteful in that they typically fail much less frequently that the fuser and pressure rollers. Indeed, if they were not part of the fusing system, the internal heating elements, temperature sensors, and associated electrical connectors would most likely last as long as the imaging device without replacement.

From the foregoing, it can be appreciated that it would be desirable to have a simplified fusing system such that fewer components are discarded when the fuser and pressure rollers of the fusing system are replaced.

SUMMARY OF THE INVENTION

The present disclosure relates to a fusing system for fusing toner to a recording medium. The fusing system comprises a fuser roller that does not have an internal heat source, a pressure roller that does not have an internal heat source, the pressure roller being in contact with the fuser roller, and an external heat source that heats at least one of the fuser and pressure rollers.

In addition, the present disclosure relates to a method for heating in a fusing system. The method comprises the steps of providing a fuser roller and a pressure roller that do not have internal heat sources, providing an external heating source that is associated with at least one of the fuser and pressure rollers, and heating the at least one of the fuser and pressure rollers with the external heating source.

The present disclosure further relates to a method for replacing a fusing system of an imaging device. The method comprises the steps of removing a fuser roller of the fusing system from the imaging device, removing a pressure roller of the fusing system from the imaging device, leaving all heat sources of the fusing system in place within the imaging device, inserting a new fuser roller into the fusing system, and inserting a new pressure roller into the fusing system.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
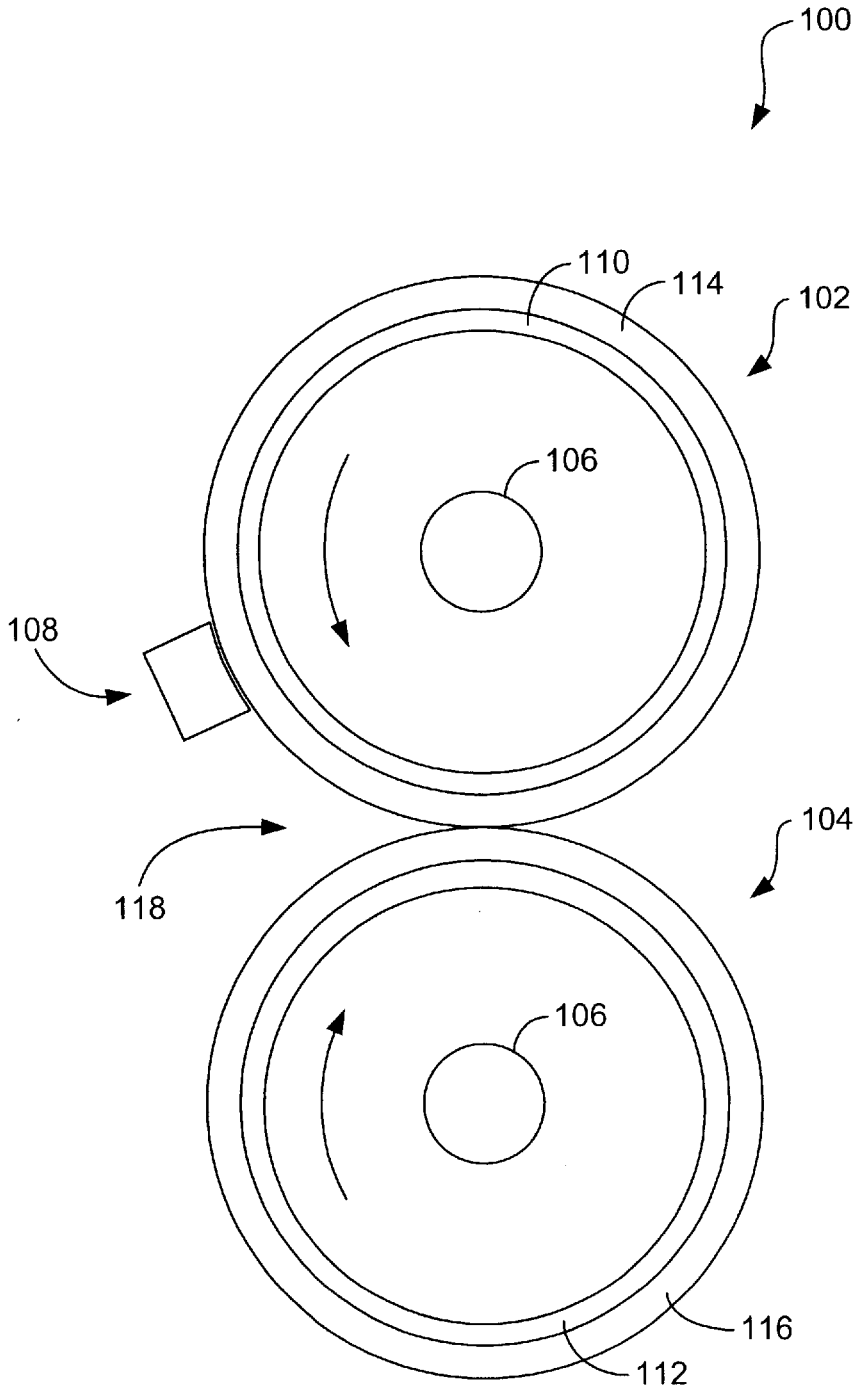
FIG. 1 (PRIOR ART)
FIG. 1 is a simplified end view of a prior art fusing system.
Figure 2:
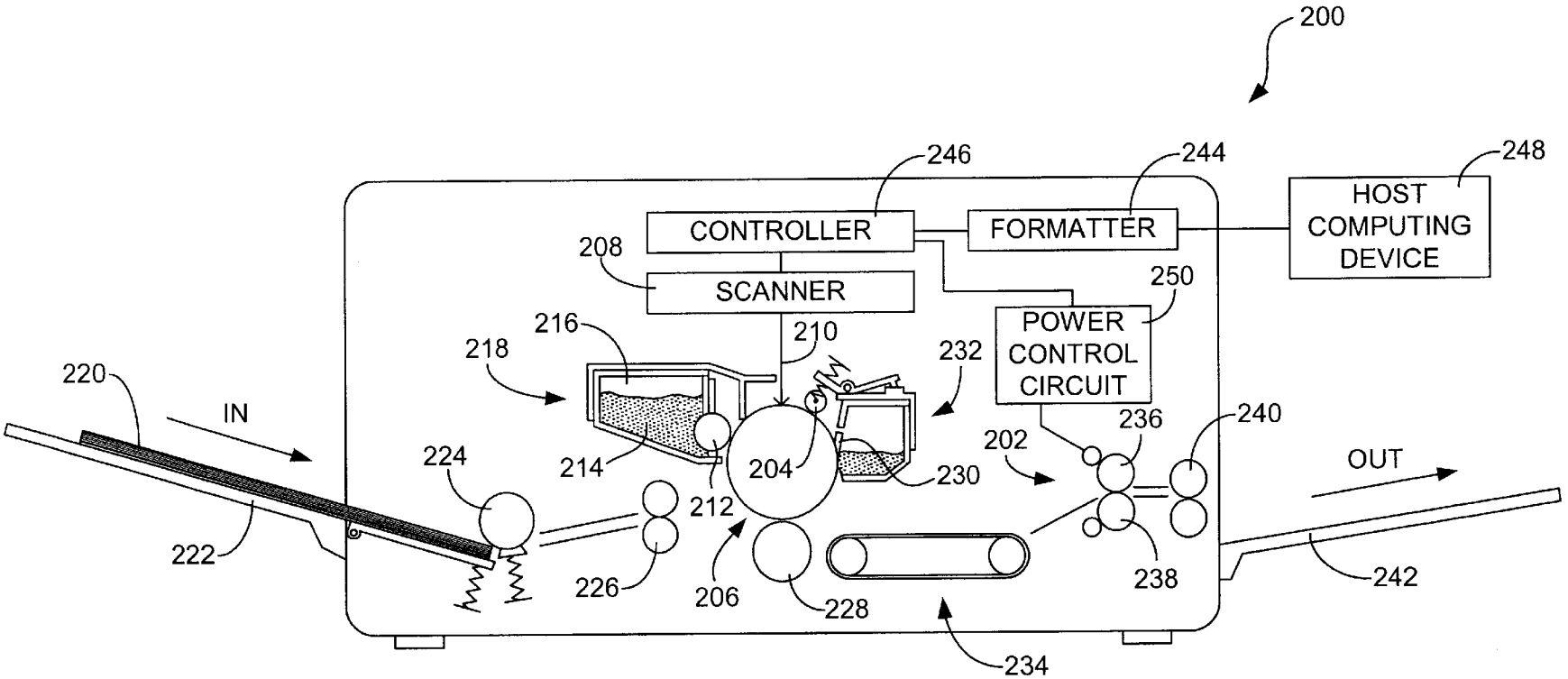
FIG. 2 is a schematic side view of an electrophotographic imaging device incorporating a first fusing system.

Referring now in more detail to the drawings, in which like numerals indicate corresponding parts throughout the several views, FIG. 2 illustrates a schematic side view of an electrophotographic imaging device 200 that incorporates a first fusing system 202. By way of example, the device 200 comprises a laser printer. It is to be understood, however, that the device 200 can, alternatively, comprise any other such imaging device that uses a fusing system including, for instance, a photocopier or a facsimile machine.

As indicated in FIG. 2, the device 200 includes a charge roller 204 that is used to charge the surface of a photoconductor drum 206, to a predetermined voltage. A laser diode (not shown) is provided within a laser scanner 208 that emits a laser beam 210 which is pulsed on and off as it is swept across the surface of the photoconductor drum 206 to selectively discharge the surface of the photoconductor drum. In the orientation shown in FIG. 2, the photoconductor drum 206 rotates in the counterclockwise direction. A developing roller 212 is used to develop a latent electrostatic image residing on the surface of photoconductor drum 206 after the surface voltage of the photoconductor drum has been selectively discharged. Toner 214 is stored in a toner reservoir 216 of an electrophotographic print cartridge 218. The developing roller 212 includes an internal magnet (not shown) that magnetically attracts the toner 214 from the print cartridge 218 to the surface of the developing roller. As the developing roller 212 rotates (clockwise in FIG. 2), the toner 214 is attracted to the surface of the developing roller 212 and is then transferred across the gap between the surface of the photoconductor drum 206 and the surface of the developing roller to develop the latent electrostatic image.

Recording media 220, for instance sheets of paper, are loaded from an input tray 222 by a pickup roller 224 into a conveyance path of the device 200. Each recording medium 220 is individually drawn through the device 200 along the conveyance path by drive rollers 226 such that the leading edge of each recording medium is synchronized with the rotation of the region on the surface of the photoconductor drum 206 that comprises the latent electrostatic image. As the photoconductor drum 206 rotates, the toner adhered to the discharged areas of the drum contacts the recording medium 220, which has been charged by a transfer roller 228, such that the medium attracts the toner particles away from the surface of the photoconductor drum and onto the surface of the medium. Typically, the transfer of toner particles from the surface of the photoconductor drum 206 to the surface of the recording medium 220 is not completely efficient. Therefore, some toner particles remain on the surface of the photoconductor drum. As the photoconductor drum 206 continues to rotate, the toner particles that remain adhered to the drum's surface are removed by a cleaning blade 230 and deposited in a toner waste hopper 232.

As the recording medium 220 moves along the conveyance path past the photoconductor drum 206, a conveyer 234 delivers the recording medium to the fuser system 202. The recording medium 220 passes between a fuser roller 236 and a pressure roller 238 of the fusing system 202 that are described in greater detail below. As the pressure roller 238 rotates, the fuser roller 236 is rotated and the recording medium 220 is pulled between the rollers. The heat applied to the recording medium 220 by the fusing system 202 fuses the toner to the surface of the recording medium. Finally, output rollers 240 draw the recording medium 220 out of the fusing system 202 and delivers it to an output tray 242.

As identified in FIG. 2, the device 200 can further include a formatter 244 and a controller 246. The formatter 244 receives print data, such as a display list, vector graphics, or raster print data, from a print driver operating in conjunction with an application program of a separate host computing device 248. The formatter 244 converts the print data into a stream of binary print data and sends it to the controller 246. In addition, the formatter 244 and the controller 246 exchange data necessary for controlling the electrophotographic imaging process. In particular, the controller 246 supplies the stream of binary print data to the laser scanner 208. The binary print data stream sent to the laser diode within the laser scanner 208 pulses the laser diode to create the latent electrostatic image on the photoconductor drum 206.

In addition to providing the binary print data stream to the laser scanner 208, the controller 246 controls a high voltage power supply (not shown) that supplies voltages and currents to the components used in the device 200 including the charge roller 204, the developing roller 212, and the transfer roller 228. The controller 246 further controls a drive motor (not shown) that drives the printer gear train (not shown) as well as the various clutches and feed rollers (not shown) necessary to move recording media 220 through the conveyance path of the device 200.

A power control circuit 250 controls the application of power to the fusing system 202. In a preferred arrangement, the power control circuit 250 is configured in the manner described in U.S. Pat. Nos. 5,789,723 and 6,018,151, which are hereby incorporated by reference into the present disclosure, such that the power to the fusing system 202 is linearly controlled and the power levels can be smoothly ramped up and down as needed. Such operation provides for better control over the amount of heat generated by the fusing system 202. While the device 200 is waiting to begin processing a print or copying job, the temperature of the fuser roller 236 and pressure roller 238 is kept at a standby temperature corresponding to a standby mode.

In the standby mode, power is supplied at a reduced level to the fuser roller 236 and pressure roller 238 by the power control circuit 250 to reduce power consumption, lower the temperature, and reduce the degradation resulting from continued exposure to the components of the fusing system 202 to the fusing temperatures. The standby temperature of the fuser roller 236 and pressure roller 238 is selected to balance a reduction in component degradation against the time required to heat the fuser roller from the standby temperature to the fusing temperature. From the standby temperature, the fuser roller 236 and pressure roller 238 can be quickly heated to the temperature necessary to fuse toner to the recording media 220. When processing of a fusing job begins, the controller 246, sufficiently ahead of the arrival of a recording medium 220 at the fusing system 202, increases the power supplied by the power control circuit 250 to the fusing system to bring its temperature up to the fusing temperature. After completion of the fusing job, the controller 246 sets the power control circuit 250 to reduce the power supplied to the fusing system 202 to a level corresponding to the standby mode. The cycling of the power supplied to fusing system 202 is ongoing during the operation of device as fusing jobs are received and processed and while the device is idle.

Figure 3:
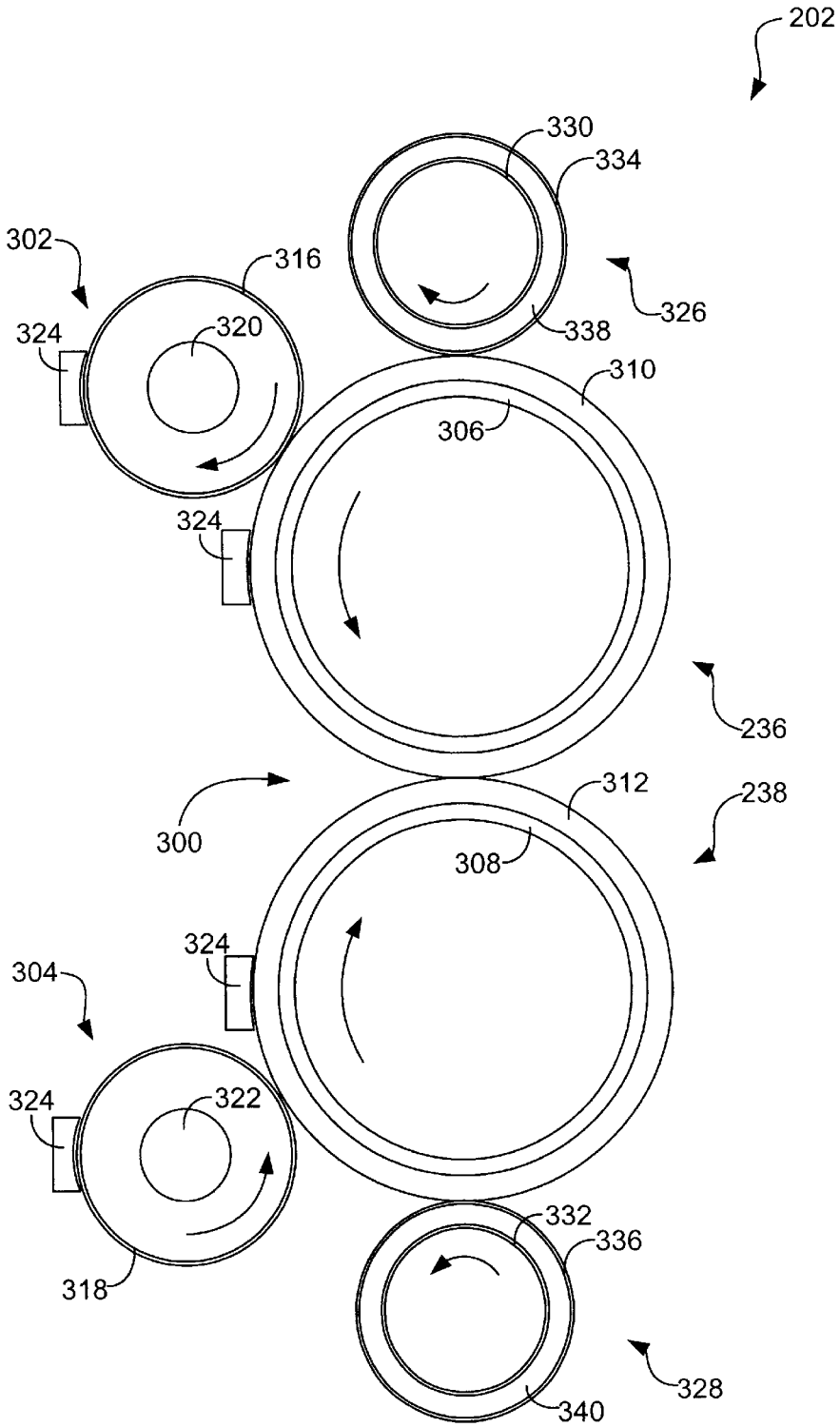
FIG. 3 is a simplified end view of the fusing system shown in FIG. 2.

FIG. 3 illustrates a simplified end view of the fusing system 202 shown in FIG. 2. As indicated in FIG. 3, the fusing system 202 generally comprises the fuser roller 236 and the pressure roller 238 that together form a nip 300 therebetween. In addition, the fusing system 202 includes external heating rollers 302 and 304. The fuser roller 236 and pressure roller 238 typically are formed as hollow tubes 306 and 308. By way of example, each of these tubes 306 and 308 is composed of a metal such as aluminum or steel and has a diameter of approximately 45 millimeters (mm). By further way of example, each tube 306 and 308 has a thickness of approximately 2.5 mm. Each roller 306 and 308 is provided with an outer layer 310 and 312 of an elastomeric material such as silicon rubber or a flexible thermoplastic. By way of example, the outer layers 310 and 312 are approximately 2 to 5 mm thick. To prevent toner from adhering to the outer layers 310 and 312, a layer of Teflon (not visible in FIG. 3) can be applied to the outer layers. This layer of Teflon can, for instance, have a thickness of approximately 1.5 to 2 mils. Unlike as with conventional fusing systems, the fuser and pressure rollers 236 and 238 do not include internal heating elements. Instead, all heating (and associated) components are external to these rollers and, more particularly, form a permanent part of the imaging device 200 (e.g., of the print engine). Although particular arrangements have been shown and described for the fuser and pressure rollers 236 and 238, it will be understood that these arrangements are exemplary only and that other arrangements are feasible and may even be preferable. As will be apparent from the disclosure that follows, more important is the simplified nature of the fusing system 202 so as to reduce the number of components that are replaced along with the fuser and pressure rollers 236 and 238.

The external heating rollers 302 and 304 comprise hollow tubes 316 and 318. The hollow tubes 316 and 318 typically are composed of a metal such as aluminum or steel and, by way of example, can have a diameter of approximately 1 inch (in). As indicated in FIG. 3, the external heating rollers 316 and 318 can be arranged at approximately the ten o'clock and eight o'clock positions relative to the fuser roller 236 and pressure roller 238, respectively. The tubes 316 and 318 can be thinner than the tubes 306 and 308 in that the external heating rollers 302 and 304 need not be compressed to form a nip. By way of example, this thickness can be approximately 0.03 in. Typically formed on the exterior of the hollow tubes 316 and 318 are layers of Teflon (not visible in FIG. 3) that, for instance, have a thickness of approximately 1.5 to 2 mils. As with the other Teflon layers, these Teflon layers reduce the likelihood of toner adhering to the external heating rollers 302 and 304 during use.

The external heating rollers 302 and 304 normally comprise internal heating elements 320 and 322 that, by way of example, comprise tungsten filament halogen lamps or nichrome heating elements. When formed as tungsten filament halogen lamps, the internal heating elements 320 and 322 can have power ratings of, for example, approximately 600 watts (W). Also provided in the fusing system 302 is one or more temperature sensors 324. The temperature sensors 324 can comprise sensors that are placed in close proximity to or in contact with the rollers (e.g., thermistors). By way of example, the sensors 324 for each of the rollers 236, 238, 302, and 304 can be positioned at the nine o'clock position. Although this placement is shown and described, it will be appreciated that alternative placement is also feasible. Furthermore, it is to be appreciated that the sensors 324 can, alternatively, comprise non-contact thermopiles (not shown), if desired. Although non-contact thermopiles are more expensive, in that they are not replaced with the fuser and pressure rollers 236 and 238, greater cost can be expended. Such non-contact thermopiles may even be preferable in that non-contact thermopiles have greater reliability.

As is further indicated in FIG. 3, the fusing system 202 can optionally include heat distribution rollers 326 and 328 that are used to reduce temperature gradients along the lengths of the fuser and pressure rollers 236 and 238. When provided, each heat distribution roller 326 and 328 can be arranged as a heat pipe that is placed in rolling contact with the fuser and pressure heat distribution rollers 236 and 238. In such an arrangement, the heat distribution rollers 326 and 328 each generally comprise an inner tube 330 and 332, and a coaxial outer tube 334 and 336 that surrounds the inner tube. Alternatively the heat distribution rollers 326 and 328 can comprise single seal tubes (not shown). When arranged as coaxial tubes, each of the inner and outer tubes is hollow and typically composed of a metal such as aluminum, copper, or steel. Of these metals, copper is preferable due to its high thermal conductivity and resistance to high pressures, although copper is more expensive. The inner and outer tubes can be connected with spacers 338 and 340 that are, for instance, welded and/or braised to the tubes. Typically, the outer surfaces of the outer tubes 334 and 336 are coated with a layer of Teflon to prevent toner from accumulating on the rollers 326 and 328. This layer of Teflon can, for instance, have a thickness of approximately 1.5 to 2 mils. In addition to the heat distribution rollers 326 and 328, the system 202 can further include one or more cleaning rollers (not shown) that, as known in the art, can be used to remove toner from the fusing system rollers.

The inner and outer tubes of the heat distribution rollers 326 and 328 define interior spaces (not shown) in which liquid, e.g. water or ethylene glycol, can be injected. In addition, the interior spaces may include means for transporting liquid within the interior spaces such as wicking material or grooves formed within the outer tubes 334 and 336. Normally only a small volume of liquid is needed, e.g. a few cubic centimeters. After the liquid has been injected into the interior spaces, the spaces are evacuated such that they are maintained in a vacuum. By way of example, the pressure within the interior spaces after evacuation can be approximately 1 in of mercury (Hg) for water and approximately 70 microns of Hg for ethylene glycol.

In operation, power is supplied to the heating elements 320 and 322 by the control circuit 250 (FIG. 2) so as to heat each of the external heating rollers 302 and 304 with radiated heat. By way of example, power is supplied to the heating elements 320 and 322 such that the fuser and pressure rollers 236 and 238 are maintained at set point temperatures of approximately 185° C. to 195° C. Due to the use of the external heating rollers 302 and 304, the fuser roller 236 and the pressure roller 238 can be replaced independently of the heating elements 320 and 322, as well as their associated electrical connectors. Typically, such replacement is facilitated by guides or stops of the imaging device 200 (not shown) that guide the rollers 236 and 238 into the position as they are installed. In that all temperature sensors 324 are permanent parts of the imaging device 200, these sensors also need not be replaced along with the fuser and pressure rollers 236 and 238. Accordingly, substantial cost savings can be achieved by the device purchaser.

In addition to simplifying and lowering the cost of the fusing system 202, the arrangement illustrated in FIG. 2 further increases the ease with which the fuser and pressure rollers 236 and 238 can be heated. In particular, heat energy can be delivered directly to the outer surfaces of the fuser roller 236 and pressure roller 238 without having to first pass through the thermally insulative outer layers 310 and 312. Because of this fact, fusing system warm-up time is significantly reduced and fusing system transient response is significantly improved. Therefore, the target operating temperature of the system can be reached quickly when a printing or copying job is initiated, and this operating temperature can be regained more quickly after each recording medium passes through the nip 300. In order to more precisely control heating and avoid temperature overshoot, the temperature of each roller is preferably monitored individually with the separate temperature sensors 324 such that the power supplied to each of the heating elements 320 and 322 can be controlled such that the temperature of the outer layers 310 and 312 do not rise to a point at which damage could occur, thereby extending the useful life of the rollers 236 and 238.

Advantageous results are also obtained due to the provision of the heat distribution rollers 326 and 328. Once the fusing system 202 is heated to operating temperature, the liquid within the interior spaces of these rollers 326 and 328 is vaporized. As temperature gradients begin to form along fuser and pressure rollers 236 and 238, and therefore the heat distribution rollers in contact therewith, the relatively cool regions of the heat distribution rollers 326 and 328 condense the vapor contained within the interior spaces into liquid form. This change of state releases a large amount of energy that warms the relatively cool regions. The condensed liquid then is quickly drawn away to relatively hot regions, for instance with the wicking material and/or grooves provided within the heat distribution rollers 326 and 328. Because of the high temperature of these relatively hot regions, the liquid is again vaporized. This vaporization removes heat from the relatively hot regions and lowers their temperature. These changes of state occur continually within the interior spaces during use of the fusing system 202. Operating in this manner, the heat distribution rollers 326 and 328 redistribute heat from relatively hot regions to relatively cool regions, thereby reducing the magnitude of the temperature differentials over the lengths of the fuser and pressure rollers 236 and 238.

Figure 4:
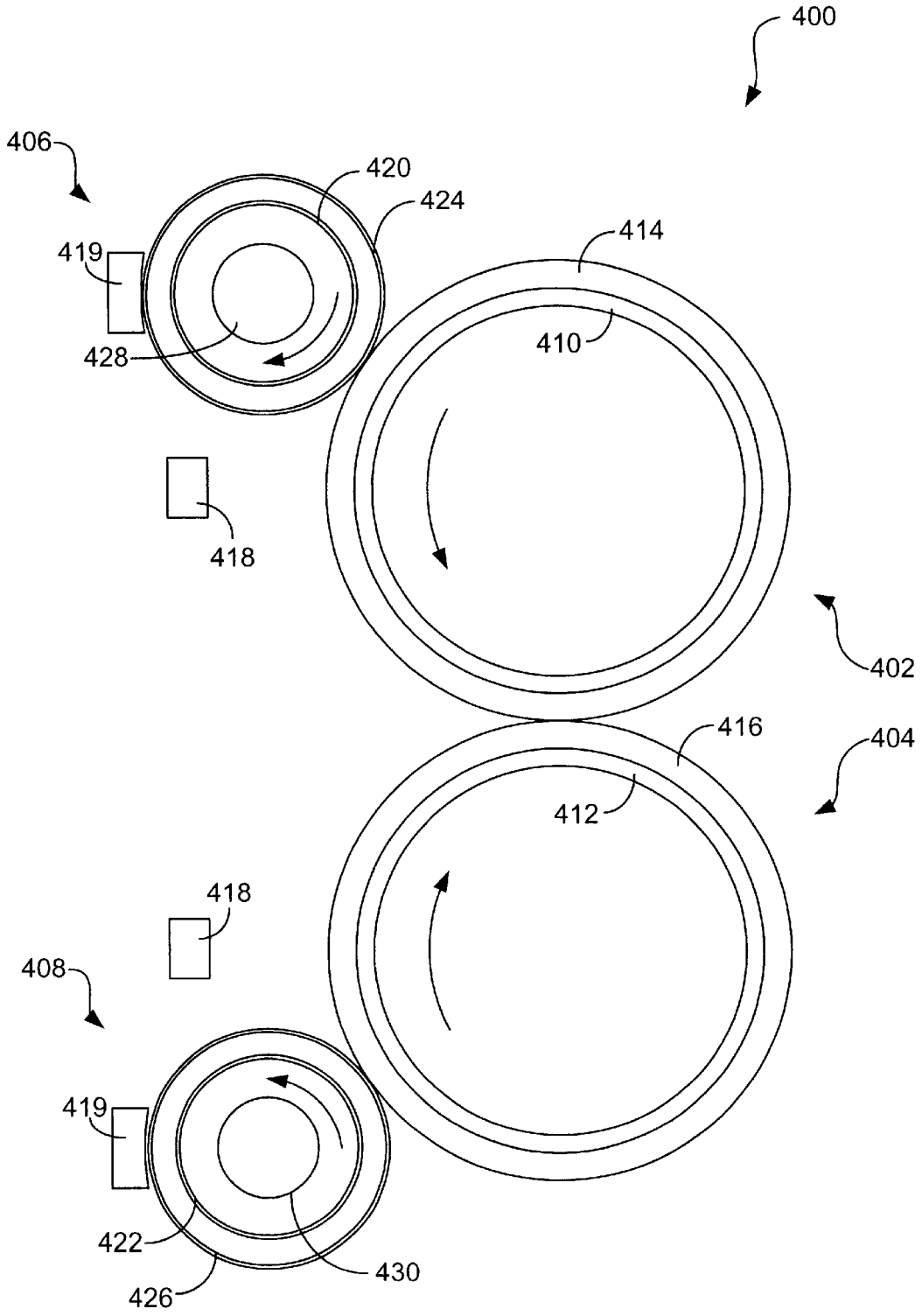
FIG. 4 is a simplified end view of a second fusing system.

FIG. 4 illustrates is a second fusing system 400. As indicated in this figure, the fusing system 400 is similar in construction to that shown in FIG. 3. Therefore, the fusing system 400 includes a fuser roller 402, a pressure roller 404, a first external heating roller 406 associated with the fuser roller, and a second external heating roller 408 associated with the pressure roller 404. Normally, the fuser roller 402 and pressure roller 404 each include a hollow tube 410 and 412 having an outer layer 414 and 416 of elastomeric material. In addition, provided are temperature sensors 418 and 419 that are used to measure the temperatures of the outer surfaces of the fuser and pressure rollers 402 and 404 and the external heating rollers 406 and 408. Temperature control of the external heating rollers 406 and 408 is preferable to limit their maximum temperature to avoid damage to the fuser and pressure rollers 402 and 404. As indicated in FIG. 4, the temperature sensors 418 preferably comprise non-contact sensors such as non-contact thermopiles and the temperature sensors 419 comprise contact sensors such as thermistors. The remote placement of the temperature sensors 418 ensures that they are not damaged when the fuser and pressure rollers 402 and 404 are replaced.

In the fusing system 400, the external heating rollers 406 and 408 are configured as heat pipes. The external heating rollers 406 and 408 therefore are similar in construction to the heat distribution rollers 326 and 328 described above and include inner tubes 420 and 422 and coaxial outer tubes 424 and 426 that together form interior spaces (not shown) in which a liquid can be injected and from which air can be evacuated. Typically, the outer surfaces of the outer tubes 424 and 426 are coated with layers of Teflon to prevent toner from accumulating on the rollers 406 and 408. In the arrangement shown in FIG. 4, the rollers 406 and 408 include internal heating elements 428 and 430. By way of example, the internal heating elements 428 and 430 comprise tungsten filament halogen lamps or nichrome heating elements.

In operation, power is supplied to the heating elements 428 and 430 by the control circuit 250 (FIG. 2) so as to heat each of the rollers 406 and 408. Once the rollers 406 and 408 are heated to the system operating temperature, the liquid within their interior spaces is vaporized in similar manner to that described above. Again, as temperature gradients are formed, heat is distributed by the condensation and re-vaporization of the liquid across the lengths of the external heating rollers 406 and 408 to reduce these gradients.

Figure 5:
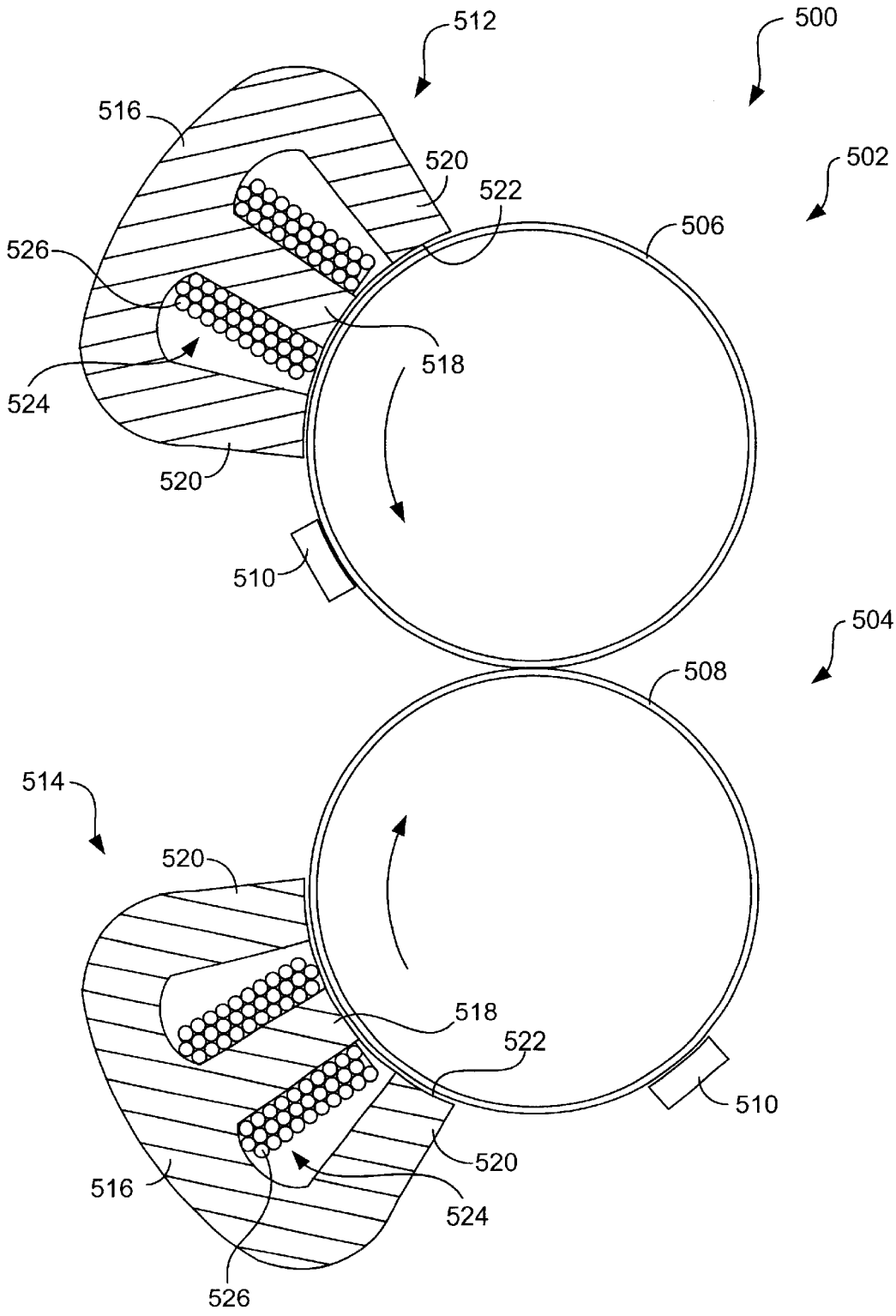
FIG. 5 is a simplified end view of a third fusing system.

FIG. 5 illustrates a third simplified fusing system 500. As shown in this figure, the fusing system 500 is again similar in construction to that shown in FIG. 3. Accordingly, the fusing system 500 includes a fuser roller 502 and a pressure roller 504. As indicated in FIG. 5, each of these rollers 502 and 504 is formed as a hollow tube 506 and 508. In one preferred arrangement, the rollers 502 and 504 comprise high temperature polymeric tubes having an electrolessly plated metal layer (not visible in FIG. 5) that coats the inner surfaces of the rollers. By way of example, the polymeric tube can be composed of polyimide and have a thickness of approximately 120 microns. The use of polyimide for the construction of the polymeric tube is advantageous because it is strong, extremely temperature resistant, and can be formed so as to result in a non-stick outer surface to which toner does not easily adhere. To enhance the non-stick attributes of the polymeric tube, a layer of Teflon (not visible in FIG. 5) can be applied to the outer surface of the tube, for instance having a thickness of approximately 1.5 to 2 mils.

By way of example, the metal layer can comprise a nickel layer that is formed on the inner surfaces of the polymeric tube through a chemical deposition process. The use of nickel is advantageous in that it is a ferromagnetic material having an extremely high saturation flux. As is known in the art, saturation flux is a quantification of the magnetic flux at which a material magnetically saturates. Beyond this flux, the material behaves as air and, therefore, can maintain no further eddy currents. When the material has a high saturation flux, the material will permit the formation of high eddy currents and therefore the generation of greater amounts of heat. Although nickel is considered a preferred material, it will be understood that other metals could be used, particularly other ferromagnetic metals. The metal layer can have a thickness of approximately 80 to 100 microns. Such small dimensions ensure beneficial heating characteristics. Specifically, the metal layer is thin enough to be heated very quickly, yet has enough thermal storage capacity to adequately transfer energy into the recording medium (e.g., piece of paper).

In a second preferred arrangement, the fuser and pressure rollers 502 and 504 comprise thin metal tubes having a coating of an elastomeric material formed on their outer surfaces such as silicon rubber or a flexible thermoplastic (not visible in FIG. 5). By way of example, the metal tubes can comprise a steam-rated copper or aluminum pipe having a thickness of approximately 3 millimeters (mm). As will be appreciated by persons having ordinary skill in the art, the metal tubes may or may not require coatings of elastomeric material. When they are used, however, the coatings can have a thicknesses of approximately 100 mils or less. Although particular arrangements have been described for the construction of the fuser roller 502 and pressure roller 504, it is to be understood that the particular configuration of these rollers is less important than the fact that they comprise metal layers, either in the form of a coating or tube. As is described below, the metal layers facilitate the formation of eddy currents that flow within the layers in response to magnetic fluxes that generate heat.

The fusing system 500 further comprises temperature sensors 510. The fusing system 500 also includes first and second external induction heating elements 512 and 514 that are positioned in close proximity to the fuser roller 502 and the pressure roller 504, respectively. The external induction heating elements 512 and 514 generally comprise pole members 516 that include a central pole 518 and opposed flux concentrators 520. As is apparent in FIG. 5, the central poles 518 and the flux concentrators 520 together form concave surfaces 522 that preferably have radiuses of curvature that closely approximate the radiuses of the fuser roller 502 and the pressure roller 504, respectively, such that a very small gap, e.g. between approximately 1 and 2 millimeters in width, is formed between the external induction heating elements 512 and 514 and the fuser and pressure rollers. The external induction heating elements 512 and 514 each further include a coil 524 that is wrapped around the central pole 518. The coil 524 comprises a plurality of turns of a continuous conductive wire 526. In a preferred arrangement, the wire 526 comprises a copper Litz wire.

During operation of the fusing system 500, high frequency, e.g. approximately 10 kHz to 100 kHz, current is delivered by the power control circuit 250 (FIG. 2) to the coils 524. As the current flows through the coil 524, high frequency magnetic fluxes are generated in the central poles 518 of the external induction heating elements 512 and 514. Due to the arrangement of the external induction heating elements 512 and 514 relative to the fuser roller 502 and the pressure roller 504, the magnetic fluxes are focused upon the fuser and pressure rollers and, therefore, upon the metal layers thereof. The magnetic fluxes travel inside the metal layers of the rollers and induce eddy currents that generate heat in the metal layers to thereby heat the fuser and pressure rollers 502 and 504.

While particular embodiments of the invention have been disclosed in detail in the foregoing description and drawings for purposes of example, it will be understood by those skilled in the art that variations and modifications thereof can be made without departing from the scope of the invention as set forth in the following claims.

What is claimed is:

1. A fusing system for fusing toner to a recording medium, comprising:

a fuser roller that does not have an internal heat source;

a pressure roller that does not have an internal heat source, the pressure roller being in contact with the fuser roller; and a heating roller external to the fuser and pressure rollers that heats at least one of the fuser and pressure rollers, wherein the heating roller is configured as a heat pipe that comprises coaxial tubes that define an interior space in which a liquid can be contained in a vacuum.

2. The system of claim 1, wherein the heating roller includes an internal heating element.

3. The system of claim 1, further comprising a heat distribution roller in contact with one of the fuser and pressure rollers.

4. The system of claim 1, wherein the system comprises two heating rollers, one in contact with the fuser roller and one in contact with the pressure roller, each heating roller being configured as a heat pipe.

5. The system of claim 4, wherein each heat pipe comprises coaxial tubes that define an interior space in which a liquid can be contained in a vacuum.

6. The system of claim 4, wherein each heating roller comprises an internal heating element.

7. A fusing system for fusing toner to a recording medium, comprising:

a fuser roller that does not have an internal heat source;

a pressure roller that does not have an internal heat source, the pressure roller being in contact with the fuser roller;

a heat source external to the fuser and pressure rollers that heats at least one of the fuser and pressure rollers; and a heat distribution roller that distributes heat across at least one of the fuser and pressure rollers, the heat distribution roller comprising coaxial tubes that define an interior space in which a liquid can be contained in a vacuum.

8. The system of claim 7, wherein the heat source comprises a heating roller in contact with one of the fuser and pressure rollers.

9. The system of claim 8, wherein the heating roller includes an internal heating element.

10. The system of claim 7, wherein the heat source comprises an external induction heating element.

11. The system of claim 7, wherein the system comprises two heat sources, one heat source being associated with the fuser roller and one heat source being associated with the pressure roller.

12. The system of claim 7, wherein the system comprises two heat distribution rollers, one distribution roller being in contact with the fuser roller and one heat distribution roller being in contact with the pressure roller.

* * * * *